US010100836B2

(12) United States Patent
Stickney et al.

(10) Patent No.: US 10,100,836 B2
(45) Date of Patent: Oct. 16, 2018

(54) FAN ASSEMBLY

(75) Inventors: Timothy Nicholas Stickney, Malmesbury (GB); Christopher Steven Hodgson, Malmesbury (GB); James John Bryden, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 819 days.

(21) Appl. No.: 13/879,309

(22) PCT Filed: Sep. 23, 2011

(86) PCT No.: PCT/GB2011/051801
§ 371 (c)(1),
(2), (4) Date: Jun. 21, 2013

(87) PCT Pub. No.: WO2012/049470
PCT Pub. Date: Apr. 19, 2012

(65) Prior Publication Data

US 2013/0272858 A1 Oct. 17, 2013

(30) Foreign Application Priority Data

Oct. 13, 2010 (GB) ..... 1017270.8
Oct. 13, 2010 (GB) ..... 1017272.4

(51) Int. Cl.
*F04D 19/00* (2006.01)
*F04D 25/08* (2006.01)
(Continued)

(52) U.S. Cl.
CPC ..... *F04D 19/002* (2013.01); *F04D 25/08* (2013.01); *F04D 29/541* (2013.01);
(Continued)

(58) Field of Classification Search
CPC ..... F04D 25/08; F04D 25/082; F04D 25/084; F04D 25/086; F04D 25/088; F04D 25/12;
(Continued)

(56) References Cited

U.S. PATENT DOCUMENTS 284,962 A 9/1883 Huston
1,357,261 A 11/1920 Svoboda
(Continued)

FOREIGN PATENT DOCUMENTS

BE 560119 8/1957
CA 1055344 5/1979
(Continued)

OTHER PUBLICATIONS

Gammack et al., U.S. Office Action dated Sep. 6, 2013, directed to U.S. Appl. No. 12/716,740; 15 pages.
(Continued)

*Primary Examiner* — Jason Shanske
*Assistant Examiner* — Julian Getachew
(74) *Attorney, Agent, or Firm* — Morrison & Foerster LLP

(57) ABSTRACT

A fan assembly includes a nozzle and a device for creating an air flow through the nozzle. The nozzle includes an interior passage, a mouth for receiving the air flow from the interior passage, and a Coanda surface located adjacent the mouth and over which the mouth is arranged to direct the air flow. The mouth and the Coanda surface extend about an axis. The Coanda surface comprises a diffuser portion, the angle subtended between the axis and the diffuser portion of the Coanda surface varying about the axis.

11 Claims, 7 Drawing Sheets

(51) Int. Cl.
*F04D 29/54* (2006.01)
*F04D 29/60* (2006.01)
*F04F 5/16* (2006.01)
*F04F 5/46* (2006.01)

(52) U.S. Cl.
CPC ..... *F04D 29/601* (2013.01); *F04F 5/16* (2013.01); *F04F 5/461* (2013.01)

(58) Field of Classification Search
CPC ..... F04D 29/541; F04D 29/547; F04D 29/52; F04D 29/40; F04D 29/44; F04D 29/441; F04D 2/545; F24F 13/06
See application file for complete search history.

(56) References Cited

U.S. PATENT DOCUMENTS 1,767,060 A 6/1930 Ferguson
1,896,869 A 2/1933 Larsh
2,014,185 A 9/1935 Martin
2,035,733 A 3/1936 Wall
2,071,266 A 2/1937 Schmidt
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,711,682 A 6/1955 Drechsel
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,729,934 A 5/1973 Denning et al.
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,417 A 1/1980 Chancellor
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,110,266 A 5/1992 Toyoshima et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,735,683 A 4/1998 Muschelknautz
5,762,034 A 6/1998 Foss
5,762,661 A 6/1998 Kleinberger et al.
5,783,117 A 7/1998 Byassee et al.
5,794,306 A 8/1998 Firdaus
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D485,895 S 1/2004 Melwani
6,789,787 B2 9/2004 Stutts
6,791,056 B2 9/2004 VanOtteren et al.
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,192,258 B2 3/2007 Kuo et al.
7,198,473 B2 4/2007 Stickland et al.
7,412,781 B2 8/2008 Mattinger et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,660,110 B2 2/2010 Vinson et al.
7,664,377 B2 2/2010 Liao

(56) References Cited

U.S. PATENT DOCUMENTS

| | | | | |
|---|---|---|---|---|
| D614,280 | S | 4/2010 | Dyson et al. | |
| 7,731,050 | B2 | 6/2010 | Huang | |
| 7,775,848 | B1 | 8/2010 | Auerbach | |
| 7,806,388 | B2 | 10/2010 | Junkel et al. | |
| 7,841,045 | B2 | 11/2010 | Shaanan et al. | |
| 8,002,520 | B2 | 8/2011 | Dawson et al. | |
| 8,092,166 | B2 | 1/2012 | Nicolas et al. | |
| 8,113,490 | B2 | 2/2012 | Chen | |
| 8,152,495 | B2 | 4/2012 | Boggess, Jr. et al. | |
| 8,246,317 | B2 | 8/2012 | Gammack | |
| 8,308,445 | B2 | 11/2012 | Gammack et al. | |
| 8,348,629 | B2 | 1/2013 | Fitton et al. | |
| 8,356,804 | B2 | 1/2013 | Fitton et al. | |
| 8,454,322 | B2 | 6/2013 | Gammack et al. | |
| 8,529,226 | B2 | 9/2013 | Li | |
| 8,544,826 | B2 | 10/2013 | Ediger et al. | |
| 8,721,307 | B2 | 5/2014 | Li | |
| 8,740,562 | B2 * | 6/2014 | Takemoto | F04D 25/0613 415/220 |
| 2002/0106547 | A1 | 8/2002 | Sugawara et al. | |
| 2003/0059307 | A1 | 3/2003 | Moreno et al. | |
| 2003/0164367 | A1 | 9/2003 | Bucher et al. | |
| 2003/0171093 | A1 | 9/2003 | Gumucio Del Pozo | |
| 2003/0190183 | A1 | 10/2003 | Hsing | |
| 2004/0022631 | A1 | 2/2004 | Birdsell et al. | |
| 2004/0049842 | A1 | 3/2004 | Prehodka | |
| 2004/0106370 | A1 | 6/2004 | Honda et al. | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2005/0069407 | A1 | 3/2005 | Winkler et al. | |
| 2005/0128698 | A1 | 6/2005 | Huang | |
| 2005/0163670 | A1 | 7/2005 | Alleyne et al. | |
| 2005/0173997 | A1 | 8/2005 | Schmid et al. | |
| 2005/0281672 | A1 | 12/2005 | Parker et al. | |
| 2006/0045777 | A1 * | 3/2006 | Kao | F04D 29/547 417/423.14 |
| 2006/0172682 | A1 | 8/2006 | Orr et al. | |
| 2006/0199515 | A1 | 9/2006 | Lasko et al. | |
| 2006/0263073 | A1 | 11/2006 | Clarke et al. | |
| 2006/0279927 | A1 | 12/2006 | Strohm | |
| 2007/0035189 | A1 | 2/2007 | Matsumoto | |
| 2007/0041857 | A1 | 2/2007 | Fleig | |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0224044 | A1 | 9/2007 | Hong et al. | |
| 2007/0269323 | A1 | 11/2007 | Zhou et al. | |
| 2008/0020698 | A1 | 1/2008 | Spaggiari | |
| 2008/0124060 | A1 | 5/2008 | Gao | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0314250 | A1 | 12/2008 | Cowie et al. | |
| 2009/0026850 | A1 | 1/2009 | Fu | |
| 2009/0032130 | A1 | 2/2009 | Dumas et al. | |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0078120 | A1 | 3/2009 | Kummer et al. | |
| 2009/0120925 | A1 | 5/2009 | Lasko | |
| 2009/0191054 | A1 | 7/2009 | Winkler | |
| 2009/0214341 | A1 | 8/2009 | Craig | |
| 2010/0114513 | A1 | 5/2010 | Mallavarapu et al. | |
| 2010/0133707 | A1 | 6/2010 | Huang | |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2011/0058935 | A1 | 3/2011 | Gammack et al. | |
| 2011/0110805 | A1 | 5/2011 | Gammack et al. | |
| 2011/0164959 | A1 | 7/2011 | Fitton et al. | |
| 2011/0223014 | A1 | 9/2011 | Crawford et al. | |
| 2011/0223015 | A1 | 9/2011 | Gammack et al. | |
| 2012/0031509 | A1 | 2/2012 | Wallace et al. | |
| 2012/0033952 | A1 | 2/2012 | Wallace et al. | |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0230658 | A1 | 9/2012 | Fitton et al. | |
| 2012/0308375 | A1 | 12/2012 | Gammack | |
| 2013/0026664 | A1 | 1/2013 | Staniforth et al. | |
| 2013/0028763 | A1 | 1/2013 | Staniforth et al. | |
| 2013/0028766 | A1 | 1/2013 | Staniforth et al. | |
| 2013/0129490 | A1 | 5/2013 | Dos Reis et al. | |
| 2013/0161842 | A1 | 6/2013 | Fitton et al. | |
| 2013/0199372 | A1 | 8/2013 | Nock et al. | |
| 2013/0280051 | A1 | 10/2013 | Nicolas et al. | |
| 2013/0280061 | A1 | 10/2013 | Stickney | |
| 2013/0280096 | A1 | 10/2013 | Gammack et al. | |
| 2013/0323100 | A1 | 12/2013 | Poulton et al. | |
| 2014/0079566 | A1 | 3/2014 | Gammack et al. | |
| 2014/0084492 | A1 | 3/2014 | Staniforth et al. | |
| 2014/0210114 | A1 | 7/2014 | Staniforth et al. | |
| 2014/0255173 | A1 | 9/2014 | Poulton et al. | |
| 2014/0255217 | A1 | 9/2014 | Li | |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201011346 | 1/2008 |
| CN | 201180678 | 1/2009 |
| CN | 201221477 | 4/2009 |
| CN | 101424279 | 5/2009 |
| CN | 101451754 | 6/2009 |
| CN | 201281416 | 7/2009 |
| CN | 201349269 | 11/2009 |
| CN | 101684828 | 3/2010 |
| CN | 201486901 | 5/2010 |
| CN | 101749288 | 6/2010 |
| CN | 201502549 | 6/2010 |
| CN | 201507461 | 6/2010 |
| CN | 101825096 | 9/2010 |
| CN | 101825101 | 9/2010 |
| CN | 101825102 | 9/2010 |
| CN | 101825103 A | 9/2010 |
| CN | 101825104 | 9/2010 |
| CN | 201568337 | 9/2010 |
| CN | 101858355 | 10/2010 |
| CN | 101936310 | 1/2011 |
| CN | 201696365 U | 1/2011 |
| CN | 201696366 | 1/2011 |
| CN | 201739199 U | 2/2011 |
| CN | 101984299 | 3/2011 |
| CN | 101985948 | 3/2011 |
| CN | 201763705 | 3/2011 |

(56) References Cited

FOREIGN PATENT DOCUMENTS

| | | | |
|---|---|---|---|
| CN | 201763706 | | 3/2011 |
| CN | 201770513 | | 3/2011 |
| CN | 201771875 | | 3/2011 |
| CN | 201779080 | | 3/2011 |
| CN | 201786777 | | 4/2011 |
| CN | 201786778 | | 4/2011 |
| CN | 201802648 | | 4/2011 |
| CN | 102095236 | | 6/2011 |
| CN | 201858204 | | 6/2011 |
| CN | 201874898 | | 6/2011 |
| CN | 201874901 | U | 6/2011 |
| CN | 201917047 | | 8/2011 |
| CN | 102251973 | A | 11/2011 |
| CN | 102287357 | | 12/2011 |
| CN | 102367813 | | 3/2012 |
| CN | 202267207 | | 6/2012 |
| CN | 202431623 | | 9/2012 |
| DE | 1 291 090 | | 3/1969 |
| DE | 24 51 557 | | 5/1976 |
| DE | 27 48 724 | | 5/1978 |
| DE | 3644567 | | 7/1988 |
| DE | 19510397 | | 9/1996 |
| DE | 197 12 228 | | 10/1998 |
| DE | 100 00 400 | | 3/2001 |
| DE | 10041805 | | 6/2002 |
| DE | 10 2009 007 037 | | 8/2010 |
| EP | 0 044 494 | | 1/1982 |
| EP | 0186581 | | 7/1986 |
| EP | 0 784 947 | | 7/1997 |
| EP | 1 094 224 | | 4/2001 |
| EP | 1 138 954 | | 10/2001 |
| EP | 1357296 | B1 | 10/2003 |
| EP | 1 779 745 | | 5/2007 |
| EP | 1 939 456 | | 7/2008 |
| EP | 1 980 432 | | 10/2008 |
| EP | 2 000 675 | | 12/2008 |
| EP | 2191142 | | 6/2010 |
| EP | 2 578 889 | | 4/2013 |
| FR | 1033034 | | 7/1953 |
| FR | 1119439 | | 6/1956 |
| FR | 1387334 | | 1/1965 |
| FR | 2 375 471 | | 7/1978 |
| FR | 2 534 983 | | 4/1984 |
| FR | 2 640 857 | | 6/1990 |
| FR | 2 658 593 | | 8/1991 |
| FR | 2794195 | | 12/2000 |
| FR | 2 874 409 | | 2/2006 |
| FR | 2 906 980 | | 4/2008 |
| FR | 2928706 | | 9/2009 |
| GB | 22235 | | 6/1914 |
| GB | 383498 | | 11/1932 |
| GB | 593828 | | 10/1947 |
| GB | 601222 | | 4/1948 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1262131 | | 2/1972 |
| GB | 1265341 | | 3/1972 |
| GB | 1 278 606 | | 6/1972 |
| GB | 1 304 560 | | 1/1973 |
| GB | 1 403 188 | | 8/1975 |
| GB | 1 434 226 | | 5/1976 |
| GB | 1501473 | | 2/1978 |
| GB | 2 094 400 | | 9/1982 |
| GB | 2 107 787 | | 5/1983 |
| GB | 2 111 125 | | 6/1983 |
| GB | 2 178 256 | | 2/1987 |
| GB | 2 185 533 | | 7/1987 |
| GB | 2185531 | | 7/1987 |
| GB | 2 218 196 | | 11/1989 |
| GB | 2236804 | | 4/1991 |
| GB | 2 240 268 | | 7/1991 |
| GB | 2242935 | | 10/1991 |
| GB | 2 285 504 | | 7/1995 |
| GB | 2 289 087 | | 11/1995 |
| GB | 2383277 | | 6/2003 |
| GB | 2 428 569 | | 2/2007 |
| GB | 2 452 593 | | 3/2009 |
| GB | 2452490 | | 3/2009 |
| GB | 2463698 | | 3/2010 |
| GB | 2464736 | | 4/2010 |
| GB | 2466058 | | 6/2010 |
| GB | 2468312 | | 9/2010 |
| GB | 2468313 | | 9/2010 |
| GB | 2468315 | | 9/2010 |
| GB | 2468317 | A | 9/2010 |
| GB | 2468319 | | 9/2010 |
| GB | 2468320 | | 9/2010 |
| GB | 2468323 | | 9/2010 |
| GB | 2468328 | | 9/2010 |
| GB | 2468331 | | 9/2010 |
| GB | 2468369 | | 9/2010 |
| GB | 2468498 | | 9/2010 |
| GB | 2473037 | | 3/2011 |
| GB | 2479760 | | 10/2011 |
| GB | 2482547 | | 2/2012 |
| GB | 2484671 | | 4/2012 |
| GB | 2484695 | A | 4/2012 |
| GB | 2484761 | | 4/2012 |
| GB | 2493231 | A | 1/2013 |
| GB | 2493505 | A | 2/2013 |
| GB | 2493507 | A | 2/2013 |
| GB | 2500011 | | 9/2013 |
| JP | 31-13055 | | 8/1956 |
| JP | 35-4369 | | 3/1960 |
| JP | 39-7297 | | 3/1964 |
| JP | 46-7230 | | 12/1971 |
| JP | 49-150403 | | 12/1974 |
| JP | 51-7258 | | 1/1976 |
| JP | 53-60100 | | 5/1978 |
| JP | 56-167897 | | 12/1981 |
| JP | 57-71000 | | 5/1982 |
| JP | 57-157097 | | 9/1982 |
| JP | 61-31830 | | 2/1986 |
| JP | 61-116093 | | 6/1986 |
| JP | 61-280787 | | 12/1986 |
| JP | 62-223494 | | 10/1987 |
| JP | 63-36794 | | 3/1988 |
| JP | 63-179198 | | 7/1988 |
| JP | 63-306340 | | 12/1988 |
| JP | 64-21300 | U | 2/1989 |
| JP | 64-58955 | | 3/1989 |
| JP | 64-83884 | | 3/1989 |
| JP | 1-138399 | | 5/1989 |
| JP | 1-224598 | | 9/1989 |
| JP | 2-146294 | | 6/1990 |
| JP | 2-218890 | | 8/1990 |
| JP | 2-248690 | | 10/1990 |
| JP | 3-52515 | | 5/1991 |
| JP | 3-267598 | | 11/1991 |
| JP | 3-286775 | | 12/1991 |
| JP | 4-43895 | | 2/1992 |
| JP | 4-366330 | | 12/1992 |
| JP | 5-157093 | | 6/1993 |
| JP | 5-164089 | | 6/1993 |
| JP | 5-263786 | | 10/1993 |
| JP | 6-74190 | | 3/1994 |
| JP | 6-86898 | | 3/1994 |
| JP | 6-147188 | | 5/1994 |
| JP | 6-257591 | | 9/1994 |
| JP | 6-280800 | | 10/1994 |
| JP | 6-336113 | | 12/1994 |
| JP | 7-190443 | | 7/1995 |
| JP | 8-21400 | | 1/1996 |
| JP | 8-72525 | | 3/1996 |
| JP | 9-100800 | | 4/1997 |
| JP | 9-178083 | | 7/1997 |
| JP | 9-287600 | | 11/1997 |
| JP | 11-502586 | | 3/1999 |
| JP | 11-227866 | | 8/1999 |
| JP | 2000-116179 | | 4/2000 |
| JP | 2000-201723 | | 7/2000 |

(56) References Cited

FOREIGN PATENT DOCUMENTS

| | | | |
|---|---|---|---|
| JP | 2001-17358 | | 1/2001 |
| JP | 2002-21797 | | 1/2002 |
| JP | 2002-138829 | | 5/2002 |
| JP | 2002-213388 | | 7/2002 |
| JP | 2003-329273 | | 11/2003 |
| JP | 2004-8275 | | 1/2004 |
| JP | 2004-208935 | | 7/2004 |
| JP | 2004-216221 | | 8/2004 |
| JP | 2005-201507 | | 7/2005 |
| JP | 2005-307985 | | 11/2005 |
| JP | 2006-89096 | | 4/2006 |
| JP | 3127331 | | 11/2006 |
| JP | 2007-138763 | | 6/2007 |
| JP | 2007-138789 | | 6/2007 |
| JP | 2008-39316 | | 2/2008 |
| JP | 2008-100204 | | 5/2008 |
| JP | 3146538 | | 10/2008 |
| JP | 2008-294243 | | 12/2008 |
| JP | 2009-44568 | | 2/2009 |
| JP | 2009-62986 | | 3/2009 |
| JP | 2010-131259 | | 6/2010 |
| JP | 2010-203764 | | 9/2010 |
| JP | 2012-31806 | | 2/2012 |
| KR | 1999-002660 | | 1/1999 |
| KR | 10-2005-0102317 | | 10/2005 |
| KR | 2007-0007997 | | 1/2007 |
| KR | 20-0448319 | | 3/2010 |
| KR | 10-2010-0055611 | | 5/2010 |
| KR | 10-0985378 | | 9/2010 |
| TW | 517825 | | 1/2003 |
| TW | 589932 | | 6/2004 |
| TW | M394383 | | 12/2010 |
| TW | M399207 | | 3/2011 |
| TW | M407299 | | 7/2011 |
| WO | WO 90/13478 | | 11/1990 |
| WO | WO-95/06822 | | 3/1995 |
| WO | WO-02/073096 | | 9/2002 |
| WO | WO 03/058795 | | 7/2003 |
| WO | WO-03/069931 | | 8/2003 |
| WO | WO-2005/050026 | | 6/2005 |
| WO | WO 2005/057091 | | 6/2005 |
| WO | WO-2006/008021 | | 1/2006 |
| WO | WO-2006/012526 | | 2/2006 |
| WO | WO 2007/024955 | | 3/2007 |
| WO | WO 2007/048205 | | 5/2007 |
| WO | WO 2008/014641 | | 2/2008 |
| WO | WO-2008/024569 | | 2/2008 |
| WO | WO-2008/139491 | | 11/2008 |
| WO | WO-2009/030879 | | 3/2009 |
| WO | WO-2009/030881 | | 3/2009 |
| WO | WO-2010/100449 | A1 | 9/2010 |
| WO | WO-2010/100451 | | 9/2010 |
| WO | WO-2010/100452 | | 9/2010 |
| WO | WO-2010/100453 | | 9/2010 |
| WO | WO-2010/100462 | | 9/2010 |
| WO | WO-2011/050041 | | 4/2011 |
| WO | WO-2012/006882 | A1 | 1/2012 |
| WO | WO-2012/033517 | A1 | 3/2012 |
| WO | WO-2012/052737 | | 4/2012 |
| WO | WO-2013/014419 | A2 | 1/2013 |

OTHER PUBLICATIONS

Gammack et al., Office Action dated Sep. 27, 2013, directed to U.S. Appl. No. 13/588,666; 10 pages.
Wallace et al., Office Action dated Oct. 23, 2013, directed to U.S. Appl. No. 13/192,223; 18 pages.
Search Report dated Jan. 26, 2011, directed to GB Application No. 1017270.8; 2 pages.
Seach Report dated Jan. 26, 2011, directed to GB Application No. 1017272.4; 2 pages.
Search Report and Written Opinion dated Jan. 31, 2012, directed to International Application No. PCT/GB2011/051801; 11 pages.
Gammack, P. et al., U.S. Office Action dated Dec. 9, 2010, directed to U.S. Appl. No. 12/203,698; 10 pages.
Gammack, P. et al., U.S. Office Action dated Jun. 21, 2011, directed to U.S. Appl. No. 12/203,698; 11 pages.
Gammack et al., Office Action dated Sep. 17, 2012, directed to U.S. Appl. No. 13/114,707; 12 pages.
Gammack, P. et al., U.S. Office Action dated Dec. 10, 2010, directed to U.S. Appl. No. 12/230,613; 12 pages.
Gammack, P. et al., U.S. Office Action dated May 13, 2011, directed to U.S. Appl. No. 12/230,613; 13 pages.
Gammack, P. et al., U.S. Office Action dated Sep. 7, 2011, directed to U.S. Appl. No. 12/230,613; 15 pages.
Gammack, P. et al., U.S. Office Action dated Jun. 8, 2012, directed to U.S. Appl. No. 12/230,613; 15 pages.
Gammack et al., U.S. Office Action dated Aug. 20, 2012, directed to U.S. Appl. No. 12/945,558; 15 pages.
Gammack et al., U.S. Office Action dated Feb. 28, 2013, directed to U.S. Appl. No. 12/945,558; 16 pages.
Fitton et al., U.S. Office Action dated Nov. 30, 2010 directed to U.S. Appl. No. 12/560,232; 9 pages.
Nicolas, F. et al., U.S. Office Action dated Mar. 7, 2011, directed to U.S. Appl. No. 12/622,844; 10 pages.
Nicolas, F. et al., U.S. Office Action dated Sep. 8, 2011, directed to U.S. Appl. No. 12/622,844; 11 pages.
Helps, D. F. et al., U.S. Office Action dated Feb. 15, 2013, directed to U.S. Appl. No. 12/716,694; 12 pages.
Fitton, et al., U.S. Office Action dated Mar. 8, 2011, directed to U.S. Appl. No. 12/716,780; 12 pages.
Fitton, et al., U.S. Office Action dated Sep. 6, 2011, directed to U.S. Appl. No. 12/716,780; 16 pages.
Gammack, P. et al., U.S. Office Action dated Feb. 14, 2013, directed to U.S. Appl. No. 12/716,515; 21 pages.
Gammack, P. et al., U.S. Office Action dated Dec. 9, 2010, directed to U.S. Appl. No. 12/716,781; 17 pages.
Gammack, P. et al., U.S. Final Office Action dated Jun. 24, 2011, directed to U.S. Appl. No. 12/716,781; 19 pages.
Gammack et al., U.S. Office Action dated Mar. 14, 2013, directed to U.S. Appl. No. 12/716,740; 15 pages.
Gammack, P. et al., U.S. Office Action dated Apr. 12, 2011, directed to U.S. Appl. No. 12/716,749; 8 pages.
Gammack, P. et al., U.S. Office Action dated Sep. 1, 2011, directed to U.S. Appl. No. 12/716,749; 9 pages.
Gammack, P. et al., U.S. Office Action dated Jun. 25, 2012, directed to U.S. Appl. No. 12/716,749; 11 pages.
Fitton et al., U.S. Office Action dated Mar. 30, 2012, directed to U.S. Appl. No. 12/716,707; 7 pages.
Gammack, P. et al., U.S. Office Action dated May 24, 2011, directed to U.S. Appl. No. 12/716,613; 9 pages.
Gammack, P. et al. U.S. Office Action dated Oct. 18, 2012, directed to U.S. Appl. No. 12/917,247; 11 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Gammack et al., U.S. Office Action dated Sep. 3, 2014, directed to U.S. Appl. No. 13/861,891; 7 pages.
Staniforth et al., U.S. Office Action dated Sep. 18, 2014, directed to U.S. Appl. No. 13/559,142; 18 pages.
Fitton et al., U.S. Office Action dated Jun. 13, 2014, directed to U.S. Appl. No. 13/274,998; 11 pages.
Fitton et al., U.S. Office Action dated Jun. 13, 2014, directed to U.S. Appl. No. 13/275,034; 10 pages.
Li et al., U.S. Office Action dated Oct. 25, 2013, directed to U.S. Appl. No. 13/686,480; 17 pages.
Gammack et al., U.S. Office Action dated Apr. 24, 2014, directed to U.S Appl. No. 12/716,740; 16 pages.
Gammack, P. et al., U.S. Office Action dated Feb. 10, 2014, directed to U.S. Appl. No. 12/716,515; 21 pages.
Fitton et al., U.S. Office Action dated Dec. 31, 2013, directed to U.S. Appl. No. 13/718,693; 8 pages.
Gammack, P. et al., Office Action dated Aug. 19, 2013, directed to U.S. Appl. No. 12/716,515; 20 pages.

(56) References Cited

OTHER PUBLICATIONS

Gammack et al., Office Action dated Jun. 12, 2013, directed towards U.S. Appl. No. 12/945,558; 20 pages.
Gammack et al., Office Action dated May 29, 2013, directed towards U.S. Appl. No. 13/588,666; 11 pages.
Wallace et al., Office Action dated Jun. 7, 2013, directed towards U.S. Appl. No. 13/192,223; 30 pages.
Search Report dated Feb. 14, 2018, directed to GB Application No. 1017270.8; 1 page.

* cited by examiner

FAN ASSEMBLY

REFERENCE TO RELATED APPLICATIONS

This application is a national stage application under 35 USC 371 of International Application No. PCT/GB2011/051801, filed Sep. 23, 2011, which claims the priority of United Kingdom Application No. 1017270.8, filed Oct. 13, 2010, and United Kingdom Application No. 1017272.4, filed Oct. 13, 2010, the entire contents of which are incorporated herein by reference.

FIELD OF THE INVENTION

The present invention relates to a fan assembly. Particularly, but not exclusively, the present invention relates to a floor or table-top fan assembly, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

WO 2009/030879 describes a fan assembly which does not use caged blades to project air from the fan assembly. Instead, the fan assembly comprises a cylindrical base which houses a motor-driven impeller for drawing a primary air flow into the base, and an annular nozzle connected to the base and comprising an annular mouth through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

SUMMARY OF THE INVENTION

In a first aspect the present invention provides a fan assembly comprising a nozzle and means for creating an air flow through the nozzle, the nozzle comprising an interior passage, a mouth for receiving the air flow from the interior passage, and a Coanda surface located adjacent the mouth and over which the mouth is arranged to direct the air flow, wherein the mouth and the Coanda surface extend about an axis; characterised in that the Coanda surface comprises a diffuser portion, the angle subtended between the axis and the diffuser portion varying about the axis.

The profile of the air current generated by the fan assembly is dependent, inter alia, on angle subtended between the axis and the diffuser portion of the Coanda surface. Through varying the angle subtended between the axis and the diffuser portion of the surface about the axis, the air current generated by the fan assembly may have a non-cylindrical or a non-frusto-conical profile without a significant change to the size or shape of the outer surface of the nozzle of the fan assembly.

Preferably, the Coanda surface is continuous about the axis. Preferably, the angle varies along the Coanda surface, that is, about the axis, between at least one maximum value and at least one minimum value. Preferably, the angle varies along the Coanda surface between a plurality of maximum values and a plurality of minimum values. In a preferred embodiment the angle varies along the Coanda surface between two maximum values and two minimum values, but this number may be greater than two. The maximum values and the minimum values are preferably regularly spaced about the axis. The minimum value may be in the range from −15° to 15°, whereas the maximum value may be in the range from 20 to 35°. In a preferred embodiment the maximum value is at least twice the minimum value.

Preferably, the angle is at a minimum value at or towards at least one of an upper extremity and a lower extremity of the Coanda surface. Locating the minimum value at one or both of these extremities can "flatten" the upper and lower extremities of the profile of the air current generated by the fan assembly so that the air flow has an oval, rather than circular, profile. The profile of the air current is preferably also widened by locating a maximum value at or towards each side extremity of the Coanda surface. Preferably, the angle subtended between the axis and the diffuser portion of the Coanda surface varies continuously about the axis.

Preferably, the depth of the nozzle, as measured along the axis, varies about the axis. This feature may be provided in isolation from the varying shape of the Coanda surface in order to modify the profile of the air flow emitted from the fan assembly. In a second aspect the present invention provides a fan assembly comprising a nozzle and means for creating an air flow through the nozzle, the nozzle comprising an interior passage, a mouth for receiving the air flow from the interior passage, and a Coanda surface located adjacent the mouth and over which the mouth is arranged to direct the air flow; characterised in that the mouth and the Coanda surface extend about an axis, and wherein the depth of the nozzle, as measured along the axis, varies about the axis.

The nozzle is preferably in the form of a loop extending about the axis.

Preferably, the depth of the nozzle varies about the axis between at least one maximum value and at least one minimum value. Preferably, the depth of the nozzle varies about the axis between a plurality of maximum values and a plurality of minimum values. In a preferred embodiment the depth varies between two maximum values and two minimum values, but this number may be greater than two. The maximum value is preferably at least 1.25 times the minimum value, more preferably at least 1.5 times the minimum value. Preferably, the minimum value is in the range from 50 to 150 mm. The depth is preferably at a maximum value at or towards at least one of an upper extremity and a lower extremity of the surface, whereas the depth is preferably at a minimum value at or towards the side extremities of the surface. Preferably, the depth varies continuously about the axis between maximum and minimum values.

Preferably, the nozzle or the Coanda surface has n-fold rotational symmetry, where n is an integer equal to or greater than 2. Increasing the value of n to three or more can result in the nozzle having a corrugated or sinuous profile in a plane orthogonal to the axis. Alternatively, the nozzle or the Coanda surface may be asymmetrical.

Preferably, the interior passage extends about the axis, with the cross-sectional area of the interior passage in a plane passing through, and parallel to, the axis being substantially constant about the axis. As a result, the air flow can be emitted generally evenly along the length of the mouth, and thus about the axis. In view of the variation about the axis of one or both of the depth of the nozzle and the angle subtended between the diffuser portion of the Coanda surface and the axis, the cross-sectional profile of the interior passage in said plane may vary about the axis to maintain the uniformity of the cross-sectional area of the interior passage.

The cross-sectional profile of the interior passage is preferably shaped so as to taper towards the front of the nozzle. The radial thickness of the nozzle may therefore decrease towards the front of the nozzle so that, in any given plane passing through, and parallel to, the axis the radial thickness of the nozzle varies between a maximum value and a minimum value. This maximum value of the radial thickness of the nozzle may also vary about the axis.

The radial distance between the front end of the nozzle and the axis may also vary about the axis. The radial distance between the front end of the nozzle and the axis may vary about the axis as a function of the depth of the nozzle, and/or as a function of the angle subtended between the axis and the diffuser portion of the Coanda surface.

The mouth is preferably continuous about said axis, and may be substantially circular in shape. Preferably, the mouth has one or more outlets, and the spacing between opposing surfaces of the nozzle at the outlet(s) of the mouth is preferably in the range from 0.5 mm to 5 mm.

Preferably, the nozzle defines an opening through which air from outside the fan assembly is drawn by the air flow emitted from the mouth. The opening is preferably located in a plane which is substantially orthogonal to said axis. The interior passage preferably extends continuously about the opening so that the opening is an enclosed opening which is surrounded by the interior passage. The mouth and the surface preferably extend about the opening, more preferably continuously about the opening.

The nozzle is preferably mounted on a base housing said means for creating an air flow. In the preferred fan assembly the means for creating an air flow through the nozzle comprises an impeller driven by a motor.

As mentioned above, the surface over which the mouth is arranged to direct the air flow is a Coanda surface. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the mouth.

In a preferred embodiment an air flow is created through the nozzle of the fan assembly. In the following description this air flow will be referred to as the primary air flow. The primary air flow is emitted from the mouth of the nozzle and preferably passes over a Coanda surface. The primary air flow entrains air surrounding the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly, and passes predominantly through the opening defined by the nozzle. The primary air flow directed over the Coanda surface combined with the entrained secondary air flow equates to a total air flow emitted or projected forward from the opening defined by the nozzle.

In a third aspect the present invention provides a fan assembly comprising a nozzle and means for creating an air flow through the nozzle, the nozzle comprising an interior passage, a mouth for receiving the air flow from the interior passage, and a Coanda surface located adjacent the mouth and over which the mouth is arranged to direct the air flow, wherein the interior passage and the mouth extend about an axis, and wherein the nozzle has a radial thickness which, in a plane passing through, and parallel to, the axis, varies between a maximum value and a minimum value, and wherein the maximum value of the radial thickness of the nozzle varies about the axis.

In a fourth aspect, the present invention provides a fan assembly comprising a nozzle and means for creating an air flow through the nozzle, the nozzle comprising an interior passage, a mouth for receiving the air flow from the interior passage, and a Coanda surface located adjacent the mouth and over which the mouth is arranged to direct the air flow, wherein the interior passage and the mouth extend about an axis, and wherein the cross-sectional area of the interior passage in a plane passing through, and parallel to, the axis is substantially constant about the axis, and the cross-sectional profile of the interior passage in a said plane varies about the axis.

In a fifth aspect the present invention provides a fan assembly comprising a nozzle and means for creating an air flow through the nozzle, the nozzle comprising an interior passage and at least one air outlet for receiving the air flow from the interior passage and for emitting the air flow from the nozzle, wherein the interior passage extends about an axis to define an opening through which air from outside the fan assembly is drawn by the air flow emitted from the at least one air outlet, wherein the depth of the nozzle, as measured along the axis, varies about the axis.

In a sixth aspect the present invention provides a fan assembly comprising a nozzle and means for creating an air flow through the nozzle, the nozzle comprising an interior passage and at least one air outlet for receiving the air flow from the interior passage and for emitting the air flow from the nozzle, wherein the interior passage extends about an axis to define an opening through which air from outside the fan assembly is drawn by the air flow emitted from the at least one air outlet, and wherein the nozzle has a radial thickness which, in a plane passing through, and parallel to, the axis, varies between a maximum value and a minimum value, and wherein the maximum value of the radial thickness of the nozzle varies about the axis.

In a seventh aspect, the present invention provides a fan assembly comprising a nozzle and means for creating an air flow through the nozzle, the nozzle comprising an interior passage and at least one air outlet for receiving the air flow from the interior passage and for emitting the air flow from the nozzle, wherein the interior passage extends about an axis to define an opening through which air from outside the fan assembly is drawn by the air flow emitted from the at least one air outlet, and wherein the cross-sectional area of the interior passage in a plane passing through, and parallel to, the axis is substantially constant about the axis, and the cross-sectional profile of the interior passage in a said plane varies about the axis.

Features described above in connection with the first aspect of the invention are equally applicable to each of the second to seventh aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
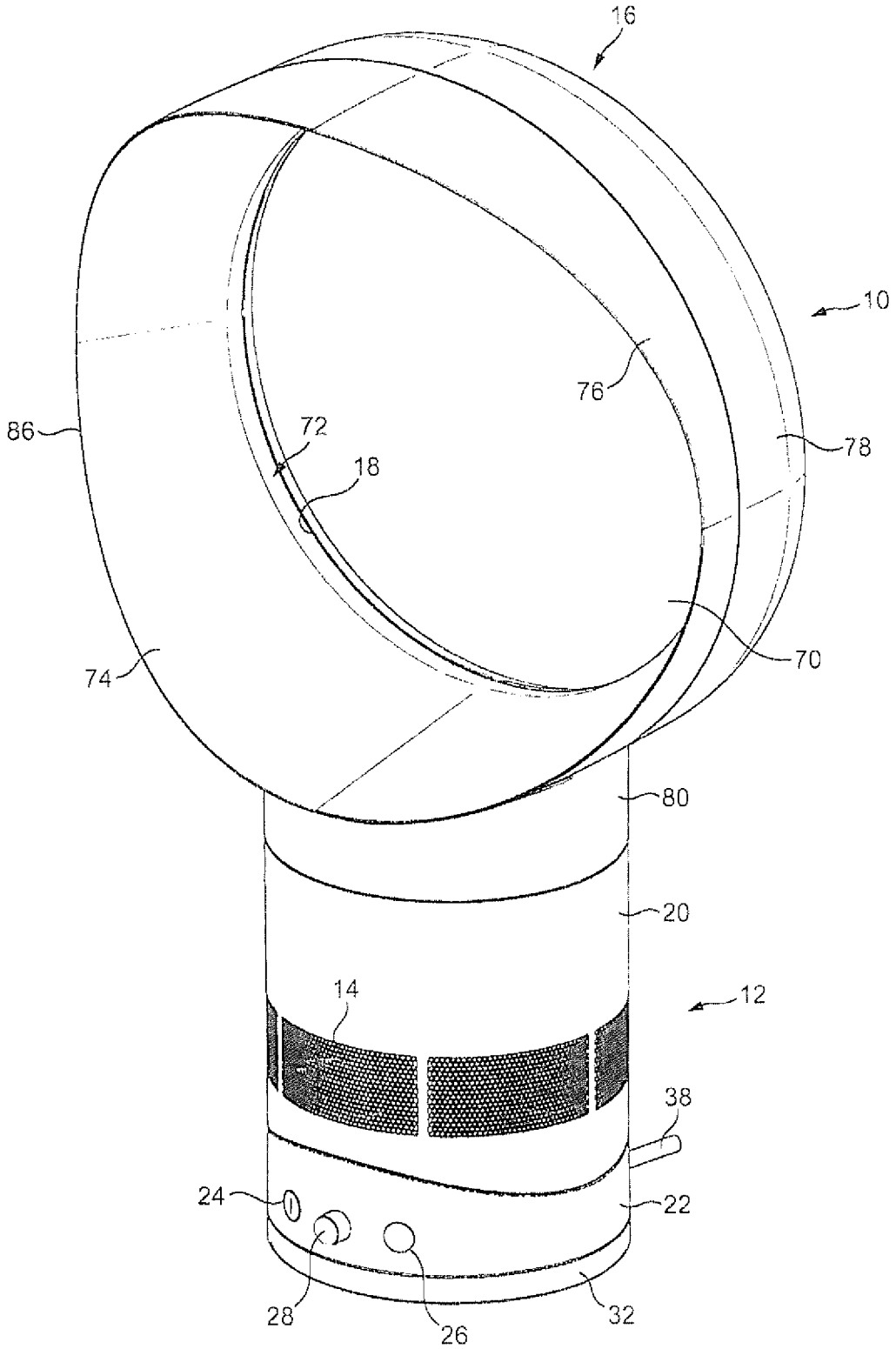
FIG. 1 is a front perspective view, from above, of a fan.
Figure 2:
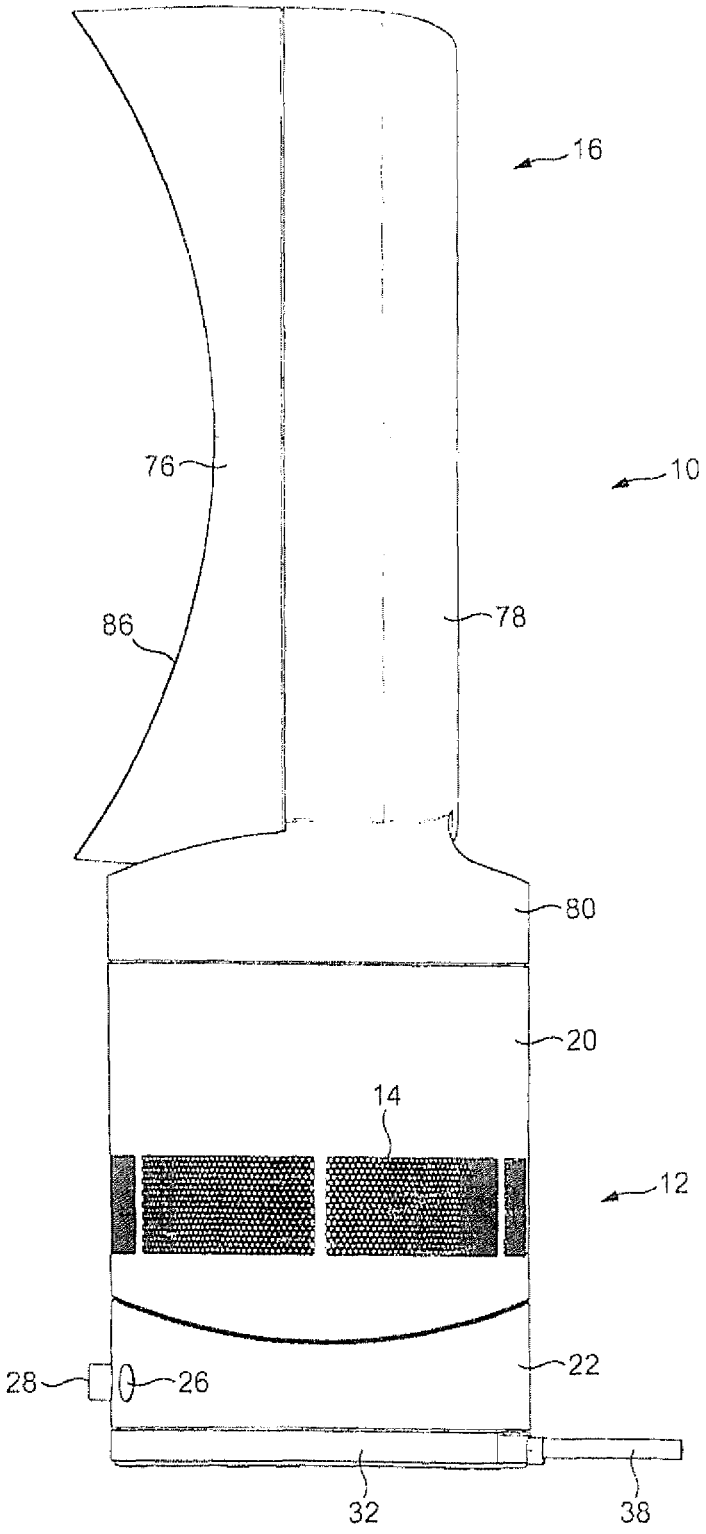
FIG. 2 is a left side view of the fan.

FIGS. 1 to 4 are external views of a fan assembly 10. The fan assembly 10 comprises a body 12 comprising an air inlet 14 through which a primary air flow enters the fan assembly 10, and a nozzle 16 in the form of an annular casing mounted on the body 12, and which comprises a mouth 18 for emitting the primary air flow from the fan assembly 10.

The body 12 comprises a substantially cylindrical main body section 20 mounted on a substantially cylindrical lower body section 22. The main body section 20 and the lower body section 22 preferably have substantially the same external diameter so that the external surface of the upper body section 20 is substantially flush with the external surface of the lower body section 22. In this embodiment the body 12 has a height in the range from 100 to 300 mm, and a diameter in the range from 100 to 200 mm.

The main body section 20 comprises the air inlet 14 through which the primary air flow enters the fan assembly 10. In this embodiment the air inlet 14 comprises an array of apertures formed in the main body section 20. Alternatively, the air inlet 14 may comprise one or more grilles or meshes mounted within windows formed in the main body section 20. The main body section 20 is open at the upper end (as illustrated) thereof to provide an air outlet 23 through which the primary air flow is exhausted from the body 12.

The main body section 20 may be tilted relative to the lower body section 22 to adjust the direction in which the primary air flow is emitted from the fan assembly 10. For example, the upper surface of the lower body section 22 and the lower surface of the main body section 20 may be provided with interconnecting features which allow the main body section 20 to move relative to the lower body section 22 while preventing the main body section 20 from being lifted from the lower body section 22. For example, the lower body section 22 and the main body section 20 may comprise interlocking L-shaped members.

The lower body section 22 comprises a user interface of the fan assembly 10. The user interface comprises a plurality of user-operable buttons 24, 26, a dial 28 for enabling a user to control various functions of the fan assembly 10, and user interface control circuit 30 connected to the buttons 24, 26 and the dial 28. The lower body section 22 is mounted on a base 32 for engaging a surface on which the fan assembly 10 is located.

Figure 5:
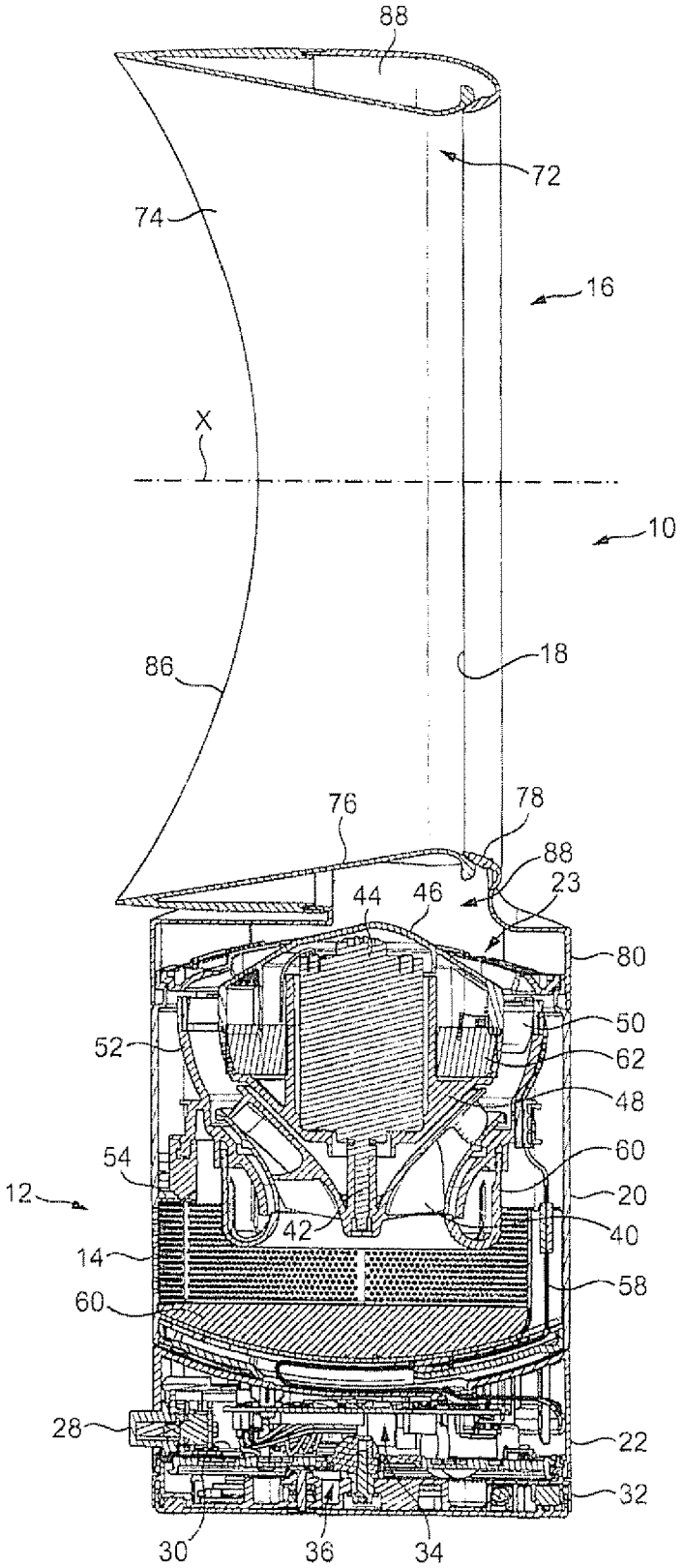
FIG. 5 is a side sectional view of the fan, taken along line A-A in FIG. 4.

FIG. 5 illustrates a sectional view through the body fan assembly. The lower body section 22 houses a main control circuit, indicated generally at 34, connected to the user interface control circuit 30. In response to operation of the buttons 24, 26 and the dial 28, the user interface control circuit 30 is arranged to transmit appropriate signals to the main control circuit 34 to control various operations of the fan assembly 10.

The lower body section 22 also houses a mechanism, indicated generally at 36, for oscillating the lower body section 22 relative to the base 32. The operation of the oscillating mechanism 36 is controlled by the main control circuit 34 in response to the user operation of the button 26. The range of each oscillation cycle of the lower body section 22 relative to the base 32 is preferably between 60° and 120°, and in this embodiment is around 80°. In this embodiment, the oscillating mechanism 36 is arranged to perform around 3 to 5 oscillation cycles per minute. A mains power cable 38 for supplying electrical power to the fan assembly 10 extends through an aperture formed in the base 32. The cable 38 is connected to a plug (not shown) for connection to a mains power supply.

The main body section 20 houses an impeller 40 for drawing the primary air flow through the air inlet 14 and into the body 12. Preferably, the impeller 40 is in the form of a mixed flow impeller. The impeller 40 is connected to a rotary shaft 42 extending outwardly from a motor 44. In this embodiment, the motor 44 is a DC brushless motor having a speed which is variable by the main control circuit 34 in response to user manipulation of the dial 28. The maximum speed of the motor 44 is preferably in the range from 5,000 to 10,000 rpm. The motor 44 is housed within a motor bucket comprising an upper portion 46 connected to a lower portion 48. The upper portion 46 of the motor bucket comprises a diffuser 50 in the form of a stationary disc having spiral blades.

The motor bucket is located within, and mounted on, a generally frusto-conical impeller housing 52. The impeller housing 52 is, in turn, mounted on a plurality of angularly spaced supports 54, in this example three supports, located within and connected to the main body section 20 of the base 12. The impeller 40 and the impeller housing 52 are shaped so that the impeller 40 is in close proximity to, but does not contact, the inner surface of the impeller housing 52. A substantially annular inlet member 56 is connected to the bottom of the impeller housing 52 for guiding the primary air flow into the impeller housing 52. An electrical cable 58 passes from the main control circuit 34 to the motor 44 through apertures formed in the main body section 20 and the lower body section 22 of the body 12, and in the impeller housing 52 and the motor bucket.

Preferably, the body 12 includes silencing foam for reducing noise emissions from the body 12. In this embodiment, the main body section 20 of the body 12 comprises a first foam member 60 located beneath the air inlet 14, and a second annular foam member 62 located within the motor bucket.

Returning to FIGS. 1 to 4, the nozzle 16 has an annular shape, extending about a central axis X to define an opening 70. The mouth 18 is located towards the rear of the nozzle 16, and is arranged to emit the primary air flow towards the front of the fan assembly 10, through the opening 70. The mouth 18 surrounds the opening 70. In this example, the nozzle 16 defines a generally circular opening 70 located in a plane which is generally orthogonal to the central axis X. The inner annular periphery of the nozzle 16 comprises a Coanda surface 72 located adjacent the mouth 18, and over which the mouth 18 is arranged to direct the air emitted from the fan assembly 10. The Coanda surface 72 comprises a diffuser portion 74 tapering away from the central axis X.

The nozzle 16 comprises an annular front casing section 76 connected to and extending about an annular rear casing section 78. The annular sections 76, 78 of the nozzle 16 extend about the central axis X. Each of these sections may be formed from a plurality of connected parts, but in this embodiment each of the front casing section 76 and the rear casing section 78 is formed from a respective, single moulded part. The rear casing section 78 comprises a base 80 which is connected to the open upper end of the main body section 20 of the body 12, and which has an open lower end for receiving the primary air flow from the body 12.

Figure 4:
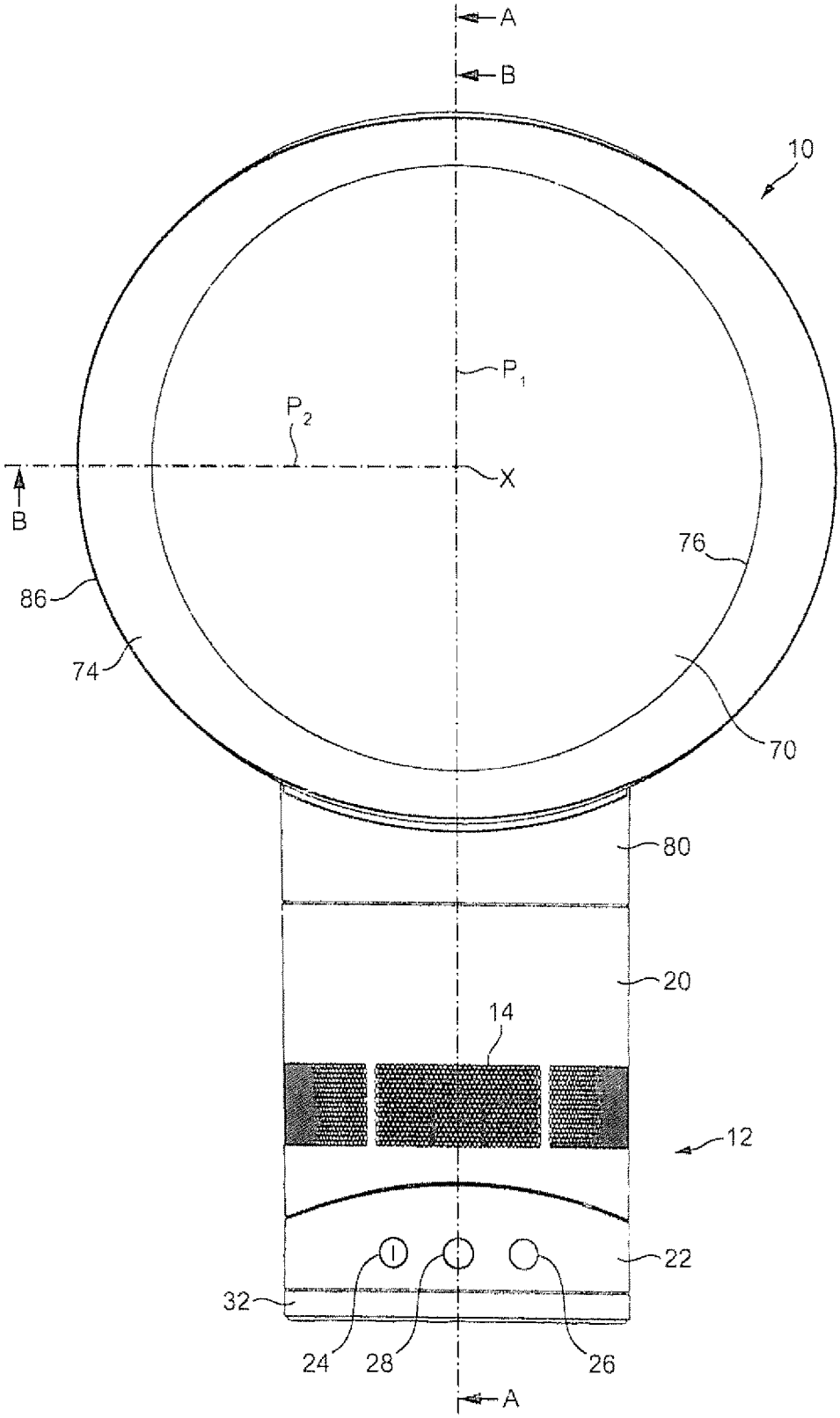
FIG. 4 is a front view of the fan.
Figure 6:
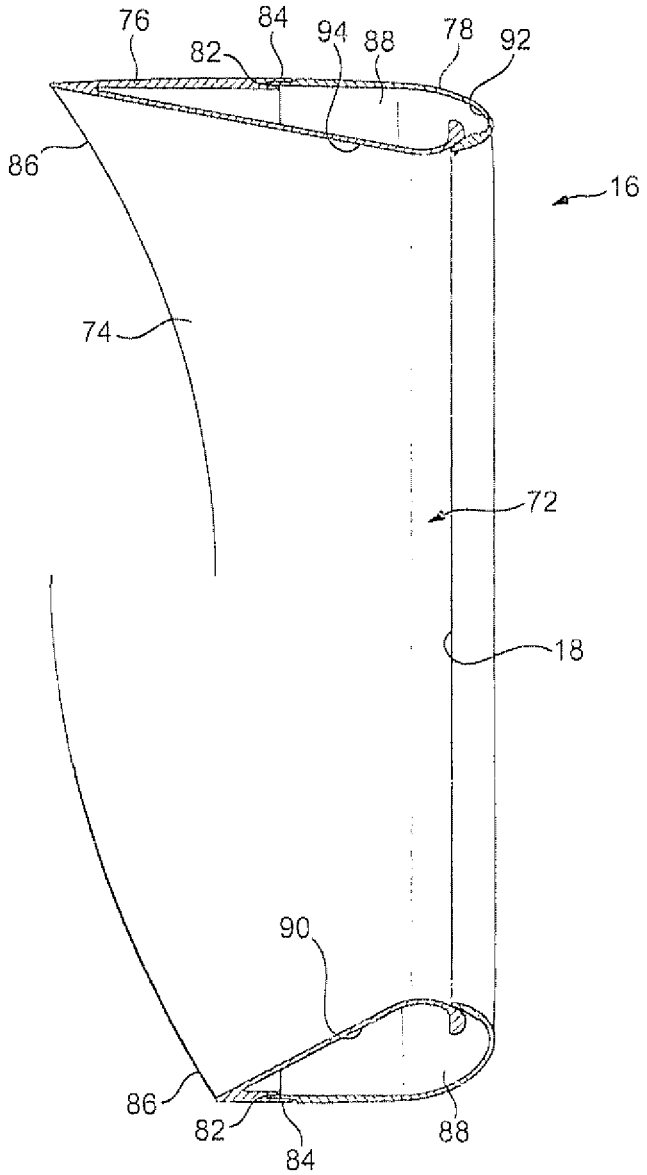
FIG. 6 is a sectional view of the air outlet of the fan, taken along line B-B in FIG. 4.
Figure 7:
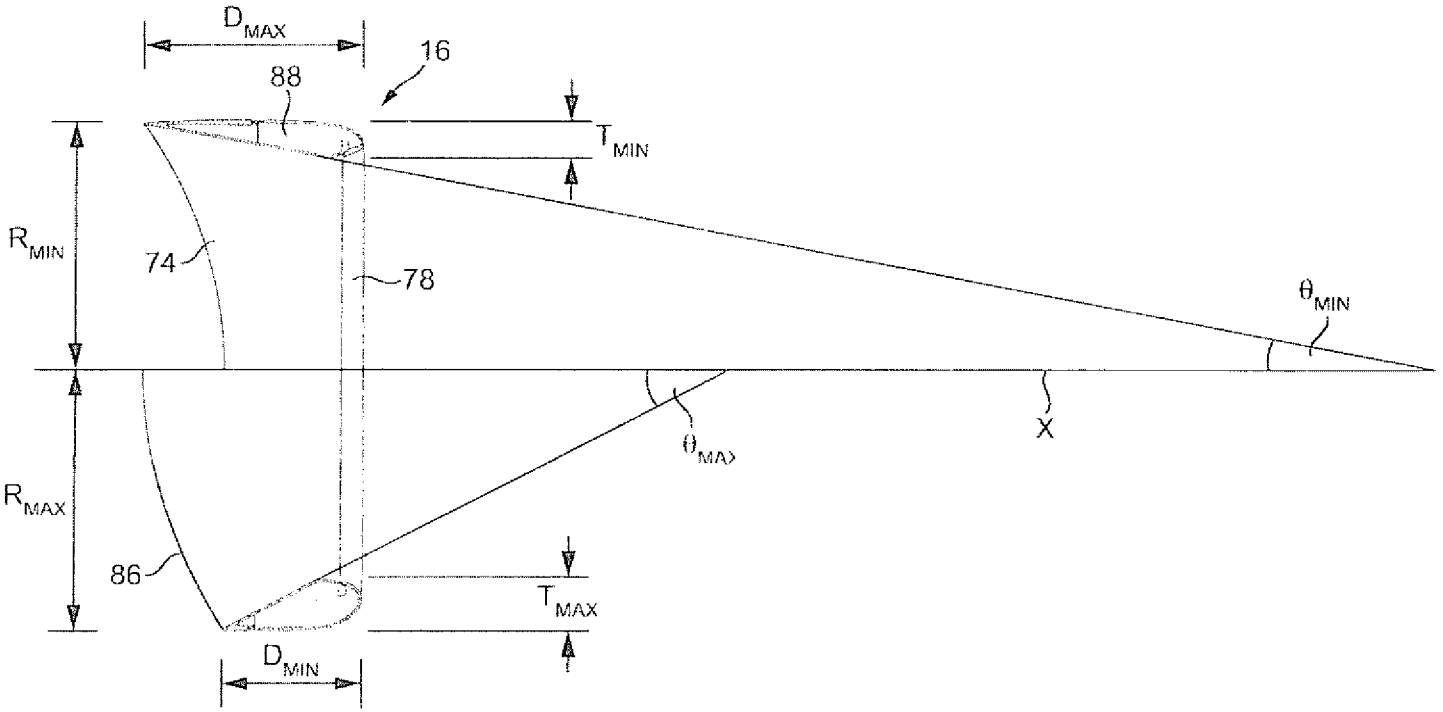
FIG. 7 is the same sectional view as FIG. 6 but with various parameters of the nozzle indicated.

Each of the casing sections 76, 78 comprises an outer portion and an inner portion connected to the outer portion. With reference also to FIGS. 5 to 7, during assembly, the front end 82 of the outer portion of the rear casing section 78 is inserted into a slot 84 located at the rear of the outer portion of the front casing section 76. Each of the front end 82 and the slot 84 is generally cylindrical. The casing sections 76, 78 may be connected together using an adhesive introduced to the slot 84. The inner and outer portions of the front casing section 76 are joined at the front end 86 of the nozzle 16. As shown in FIG. 4, the front end 86 of the nozzle 16 has a substantially constant thickness about the axis X.

The front casing section 76 and the rear casing section 78 together define an annular interior passage 88 for conveying the primary air flow to the mouth 18. The interior passage 88 extends about the axis X, and is bounded by the internal surface 90 of the front casing section 76 and the internal surface 92 of the rear casing section 78. The base 80 of the front casing section 76 is shaped to convey the primary air flow into the interior passage 88 of the nozzle 16.

The mouth 18 is defined by overlapping, or facing, portions of the internal surface 92 of the inner portion of the rear casing section 78 and the external surface 94 of the inner portion of the front casing section 76, respectively. The mouth 18 preferably comprises an air outlet in the form of an annular slot. The slot is preferably generally circular in shape, and preferably has a relatively constant width in the range from 0.5 to 5 mm. In this example the air outlet has a width of around 1 mm. Spacers may be spaced about the mouth 18 for urging apart the overlapping portions of the front casing section 76 and the rear casing section 78 to control the width of the air outlet of the mouth 18. These spacers may be integral with either the front casing section 76 or the rear casing section 78. The mouth 18 is shaped to direct the primary air flow over the external surface 94 of the front casing section 76. As mentioned above, the external surface 94 of the front casing section 76 comprises a Coanda surface 72 over which the mouth 18 is arranged to direct the air emitted from the fan assembly 10. The Coanda surface 72 is annular, and thus is continuous about the central axis X. The Coanda surface 72 may be considered to have a length which extends about the axis X, a depth extending along the axis X, and a radial thickness in a direction which is perpendicular to the axis X.

The Coanda surface 72 comprises a diffuser portion 74 tapering away from the axis X to the front end 86 of the nozzle 16. With particular reference to FIGS. 6 and 7, the angle θ subtended between the diffuser portion 74 of the Coanda surface 72 and the axis X varies about the axis X. In this example, the angle θ varies between maximum values, $\theta_{MAX}$, and minimum values, $\theta_{MIN}$, about the axis X, and thus along the length of the Coanda surface 72. In this example the angle θ comprises two maximum values, $\theta_{MAX}$, and two minimum values, $\theta_{MIN}$. The maximum values, $\theta_{MAX}$, are separated by an angle of around 180° about the axis X, and the minimum values, $\theta_{MIN}$, are similarly separated by an angle of around 180° about the axis X, with the minimum values, $\theta_{MIN}$, located midway between the maximum values, $\theta_{MAX}$. The angle θ subtended between the axis X and the diffuser portion 74 of the Coanda surface 72 varies continuously about the axis X, and so the Coanda surface 72 has 2-fold rotational symmetry.

The minimum value, $\theta_{MIN}$, is preferably in the range from −15° to 15°, whereas the maximum value, $\theta_{MAX}$, is preferably in the range from 20 to 35°. In this example the minimum value, $\theta_{MIN}$, is around 10°, whereas the maximum value, $\theta_{MAX}$, is around 28°. In this example, the angle θ is at a minimum value, $\theta_{MIN}$, at or towards the upper extremity and the lower extremity of the Coanda surface 72. As the maximum values, $\theta_{MAX}$, are separated from the minimum values, $\theta_{MIN}$, by an angle of around 90°, the angle θ is at a maximum value, $\theta_{MAX}$, at or towards the side extremities of the Coanda surface 72.

The cross-sectional area of the interior passage 88 in a plane passing through, and parallel to, the axis X is substantially constant about the axis X so that the primary air flow is emitted at a substantially constant rate about the axis X. FIGS. 6 and 7 illustrate the cross-sectional profile of the interior passage 88 in two such planes P1 and P2, indicated in FIG. 4. Planes P1 and P2 are substantially perpendicular. In the plane P1, the angle θ is at a minimum value, $\theta_{MIN}$, whereas in the plane P2 the angle θ is at a maximum value, $\theta_{MAX}$. In view of the variation of the angle θ about the axis X, and the circular shape of the slot through which the primary air flow is emitted from the nozzle 16, the cross-sectional profile of the interior passage 88 varies about the axis X to maintain a constant cross-sectional area of the interior passage 88 about the axis X.

Figure 3:
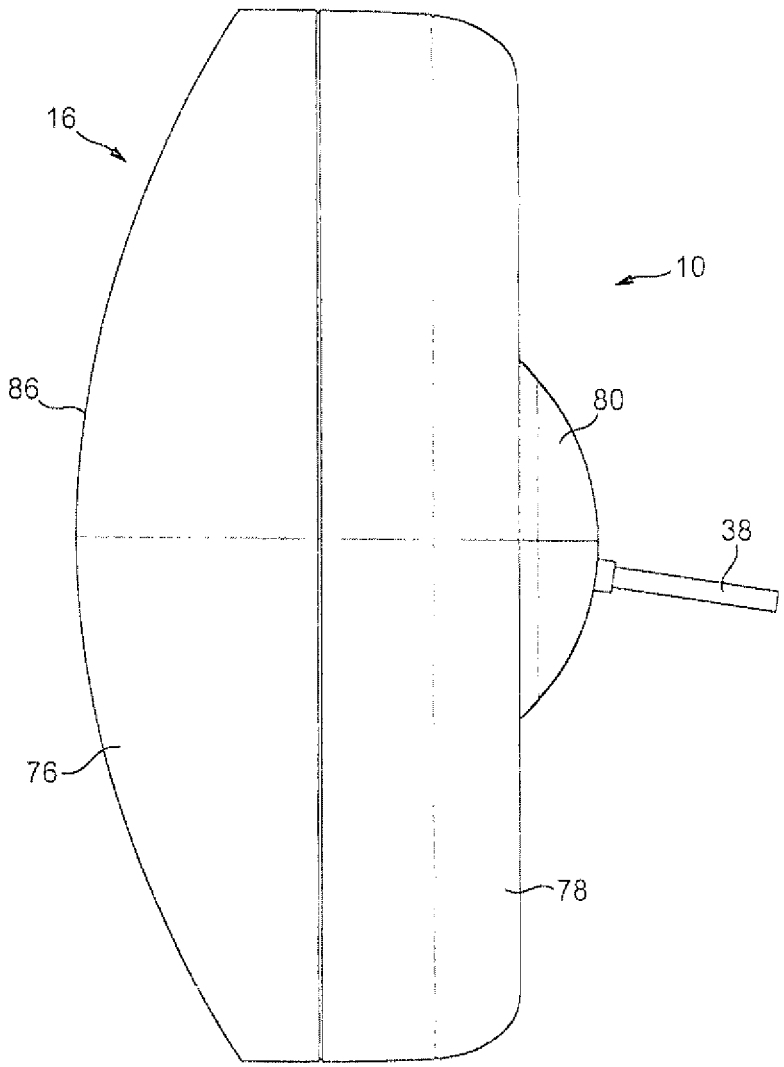
FIG. 3 is a top view of the fan.

One or more of the parameters of the nozzle 16 may vary about the axis X to maintain a constant cross-sectional area of the interior passage 88 about the axis X. As shown in FIGS. 3 and 7, the depth of the nozzle 16 along the axis X may vary as a function of the angle θ. In the plane P1, where the angle θ is at a minimum value, $\theta_{MIN}$, the depth of the nozzle 16 along the axis X is at a maximum value, $D_{MAX}$, whereas in the plane P2, where the angle θ is at a maximum value, $\theta_{MAX}$, the depth of the nozzle 16 is at a minimum value, $D_{MIN}$. The depth of the nozzle 16 thus also varies between two maximum values, $D_{MAX}$, and two minimum values, $D_{MIN}$, about the nozzle 16. Again, the maximum values, $D_{MAX}$, are separated by an angle of around 180° about the axis X, and the minimum values, $D_{MIN}$, are similarly separated by an angle of around 180° about the axis X, with the minimum values, $D_{MIN}$, located midway between the maximum values, $D_{MAX}$. The depth of the nozzle 16 also varies continuously about the axis X. In this example, $D_{MAX}$ is at least 1.25 times greater than $D_{MIN}$, and is more preferably at least 1.5 times greater than $D_{MIN}$. In this example, $D_{MIN}$ is around 85 mm and $D_{MAX}$ is around 130 mm.

The radial distance, R, between the front end 86 of the nozzle 16 and the axis X may vary about the axis X. In this example, the radial distance R varies as a function of the angle θ between a minimum value $R_{MIN}$ when the angle θ is at a minimum value and a maximum value $R_{MAX}$ when the angle θ is at a maximum value.

The maximum value of the radial thickness of the nozzle 16, as measured in a plane passing through, and parallel to, the axis X may vary about the axis X. In this example the maximum radial thickness varies as a function of the angle θ between a minimum value $T_{MIN}$ when the angle θ is at a minimum value and a maximum value $T_{MAX}$ when the angle θ is at a maximum value.

To operate the fan assembly 10 the user the user presses button 24 of the user interface. The user interface control circuit 30 communicates this action to the main control circuit 34, in response to which the main control circuit 34 activates the motor 44 to rotate the impeller 40. The rotation of the impeller 40 causes a primary air flow to be drawn into the body 12 through the air inlet 14. The user may control the speed of the motor 44, and therefore the rate at which air is drawn into the body 12 through the air inlet 14, by manipulating the dial 28 of the user interface. Depending on the speed of the motor 44, the primary air flow generated by the impeller 40 may be between 10 and 30 liters per second. The primary air flow passes sequentially through the impeller housing 52 and the air outlet 23 at the open upper end of the main body portion 20 to enter the interior passage 88 of the nozzle 16. The pressure of the primary air flow at the air outlet 23 of the body 12 may be at least 150 Pa, and is preferably in the range from 250 to 1.5 kPa.

Within the interior passage 88 of the nozzle 16, the primary air flow is divided into two air streams which pass in opposite directions around the opening 70 of the nozzle 16. As the air streams pass through the interior passage 70, air is emitted through the mouth 18. The primary air flow emitted from the mouth 18 is directed over the Coanda surface 72 of the nozzle 16, causing a secondary air flow to be generated by the entrainment of air from the external environment, specifically from the region around the mouth 18 and from around the rear of the nozzle 16. This secondary air flow passes through the central opening 70 of the nozzle 16, where it combines with the primary air flow to produce a total air flow, or air current, projected forward from the nozzle 16.

With the aforementioned variation of the angle θ about the axis X, the profile of the air current generated by the fan assembly 10 is non-circular. The profile is generally oval, with the height of the profile being smaller than the width of the profile. This flattening, or widening, of the profile of the air current can make the fan assembly 10 particularly suitable for use as a desk fan in a room, office or other environment to deliver a cooling air current simultaneously to a number of users in proximity to the fan assembly 10. Alternatively, by locating the maximum values of θ, $\theta_{MAX}$, at or towards the upper extremity and the lower extremity of the Coanda surface 72, the height of the profile of the air current may be greater than the width of the profile. This stretching of the profile of the air current in a vertical direction can make the fan assembly particularly suitable for use as a floor standing tower or pedestal fan.

The invention claimed is:

1. A fan assembly comprising a nozzle and an air flow generator that creates an air flow through the nozzle, the nozzle comprising an interior passage, downstream from the air flow generator, that receives the air flow created by the air flow generator, a mouth for receiving the air flow from the interior passage and arranged to direct the air flow over a Coanda surface located adjacent the mouth, wherein the nozzle defines an opening through which air from outside the fan assembly is drawn by the air flow emitted from the mouth, and the interior passage and the mouth extend around a longitudinal axis through a center of the opening, wherein the nozzle and the interior passage of the nozzle have a maximum thickness in a radial direction of the axis that varies around the axis, and the Coanda surface comprises a diffuser portion and an angle subtended between the axis and the diffuser portion varying around the axis.

2. The fan assembly of claim 1, wherein the Coanda surface is continuous around the axis.

3. The fan assembly of claim 1, wherein the angle varies along the surface between at least one maximum value and at least one minimum value.

4. The fan assembly of claim 1, wherein the angle varies along the Coanda surface between a maximum value and a minimum value.

5. The fan assembly of claim 1, wherein the angle subtended between the axis and the diffuser portion of the Coanda surface varies continuously around the axis.

6. The fan assembly of claim 1, wherein the Coanda surface has n-fold rotational symmetry, where n is an integer equal to or greater than 2.

7. The fan assembly of claim 1, wherein a radial distance between the axis and a front end of the nozzle varies around the axis.

8. The fan assembly of claim 1, wherein the opening is located in a plane which is substantially orthogonal to said axis.

9. The fan assembly of claim 1, wherein the nozzle is mounted on a base housing the air flow generator.

10. The fan assembly of claim 1, wherein the mouth is continuous around said axis.

11. The fan assembly of claim 10, wherein the mouth is circular in shape.

* * * * *